United States Patent [19]

Taguchi et al.

[11] Patent Number: 4,667,946

[45] Date of Patent: May 26, 1987

[54] METHOD OF PREVENTING MULTIPLE BREAKAGE OF WEBS RUNNING IN ROTARY PRESS

[75] Inventors: Toshio Taguchi; Hitoshi Matsuoka, both of Hiroshima, Japan

[73] Assignee: Mitsubishi Jukogyo Kabushiki Kaisha, Tokyo, Japan

[21] Appl. No.: 788,429

[22] Filed: Oct. 17, 1985

[30] Foreign Application Priority Data

Oct. 17, 1984 [JP] Japan ..... 59-216092

[51] Int. Cl.[4] ..... B65H 41/00; B65H 23/22

[52] U.S. Cl. ..... 270/52.5; 242/57; 101/226; 226/11; 226/4

[58] Field of Search ..... 270/52.5; 101/226, 48; 226/1, 4, 8, 11, 45; 242/57, 57.1

[56] References Cited

U.S. PATENT DOCUMENTS

| | | | |
|---|---|---|---|
| 2,838,303 | 6/1958 | Morley | 226/11 |
| 3,249,758 | 5/1966 | De Luca et al. | 242/57 X |
| 3,928,844 | 12/1975 | Meihofer | 101/226 |
| 4,078,487 | 3/1978 | McComb | 101/226 |
| 4,186,309 | 1/1980 | Gnuechtel | 242/57 |
| 4,344,073 | 8/1982 | Rawlings | 226/11 |
| 4,532,500 | 7/1985 | Henk | 242/57 |
| 4,569,285 | 2/1986 | Forno et al. | 101/232 |

FOREIGN PATENT DOCUMENTS

| | | | |
|---|---|---|---|
| 241149 | 11/1911 | Fed. Rep. of Germany | 226/11 |
| 26750 | 2/1983 | Japan | 226/11 |
| 367607 | 2/1932 | United Kingdom | 226/11 |
| 1312111 | 4/1973 | United Kingdom | 226/11 |

*Primary Examiner*—E. H. Eickholt

*Attorney, Agent, or Firm*—Wenderoth, Lind & Ponack

[57] ABSTRACT

A method of preventing the subsequent breakage of webs running in a rotary press which would be caused by a first broken web. In this method, when a signal of web breakage is received from any one of web breakage sensors which are provided to sense the breakage of any of the running webs, a nip pressure signal is changed in accordance with the number of webs still running, and is sent to a nip pressure controller to decrease the nip pressure of a triangular former drag pressing roller and nipping roller, to prevent the multiple breakage of webs.

1 Claim, 2 Drawing Figures

METHOD OF PREVENTING MULTIPLE BREAKAGE OF WEBS RUNNING IN ROTARY PRESS

BACKGROUND OF THE INVENTION

1. Field of the Invention

The present invention relates to a method of preventing the breakage of a webs in a rotary press used for multi-web printing which might lead to the breakage of another web.

2. Description of the Prior Art

In a conventional rotary press used for multi-web printing illustrated in FIG. 2, a web 2 in each unit mounted on a plurality of reel stands 1 is run to a printing unit and is printed on both sides thereof in a single color. The printed web is then guided by a group of guide rollers 4 to intermediate drag rollers 5 and is then slit into two strips each being half the width of the original one. After being slit, each of the webs is guided again by a group of guide rollers 4 to a triangular former drag roller 6 and, together with other webs which have been run from the other units, is pressed by a triangular former drag pressing roller 7 and then conveyed to a triangular former 8, before the web is sent out of the press through nipping rollers 9.

In a normal operation of multi-web printing, web breakage sensors 10 are provided at various sections in each unit for sensing web breakage at each section. When any one of the running webs is broken at any of these sections, one of the sensors 10 senses the breakage of the web and sends a signal to a controller (not shown) to stop all the units in the rotary press.

The rotary press shown in FIG. 2, is arranged such that when any one of a plurality of running webs 2 is broken, all the units are stopped. It often happens that breakage of a web causes another web 2 to be broken before all the units are stopped.

SUMMARY OF THE INVENTION

In view of the above-described fact, it is a primary object of the present invention to provide a method of preventing the subsequent breakage of a web still running in a rotary press employed for multi-web printing when a first web breaks, A web breakage sensor and a nip pressure controller are associated with each other in the rotary press, and the breaking of any web still running in the press, which would be induced to break by the breakage of the first web, can be automatically and reliably prevented during the operation of the rotary press.

To this end, according to the present invention, there is provided a method of preventing the possibility that breakage of a web in a rotary press employed for multi-web printing will lead to the breakage of another web. The method is characterized in that when a signal of web breakage is received from any one of the web breakage sensors which are provided to sense the breakage of any one of the running webs, a nip pressure signal which has been changed in accordance with the number of webs still running is sent to nip pressure controllers so as to decrease the nip pressure exerted by a triangular former drag pressing roller and nipping rollers to thereby prevent the subsequent breakage of another web.

DESCRIPTION OF THE PREFERRED EMBODIMENT

Figure 1:
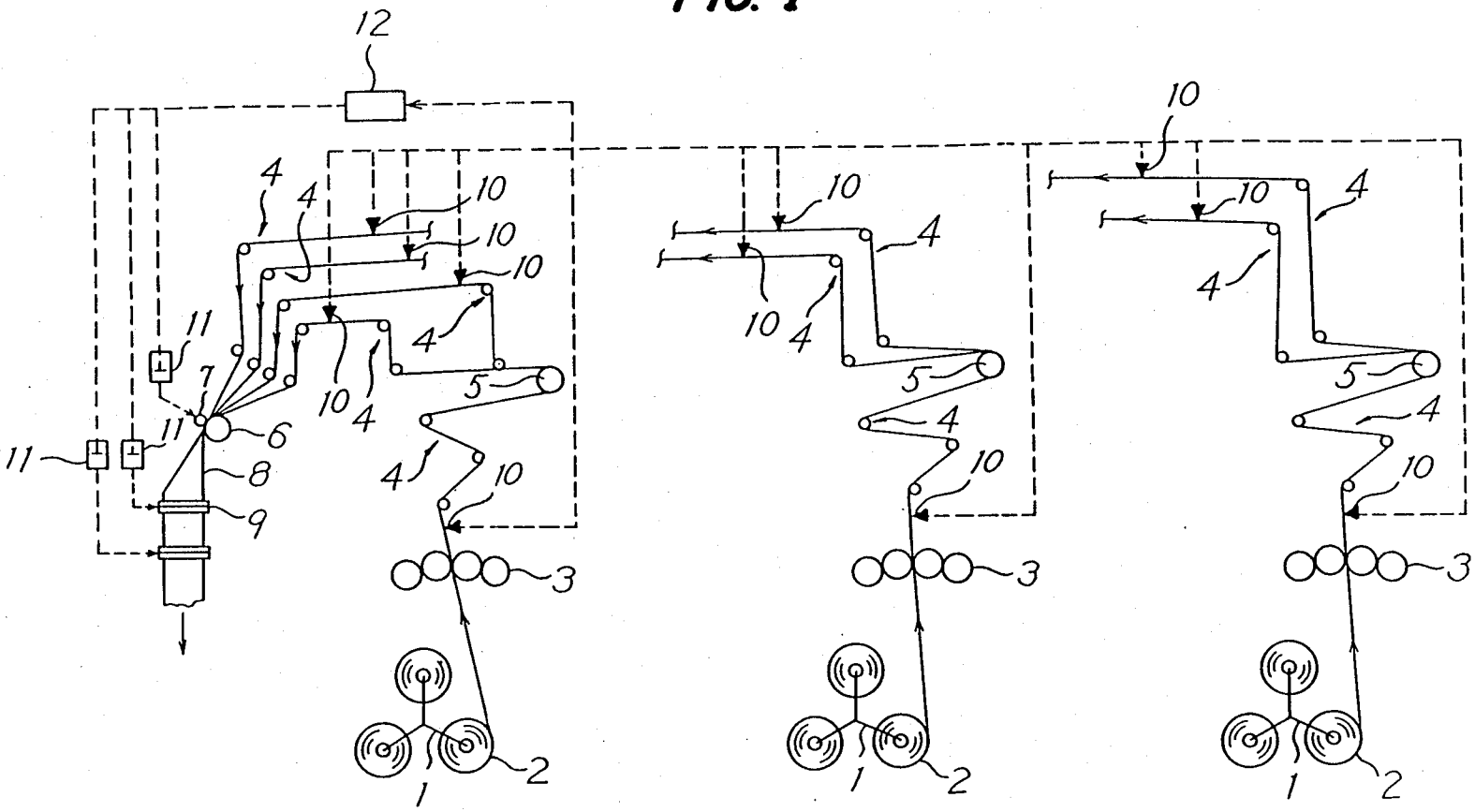
FIG. 1 is a side view of an embodiment of an apparatus which is employed in a rotary press used for multi-web printing for carrying out the method of preventing multiple breakage of webs according to the present invention.
Figure 2:
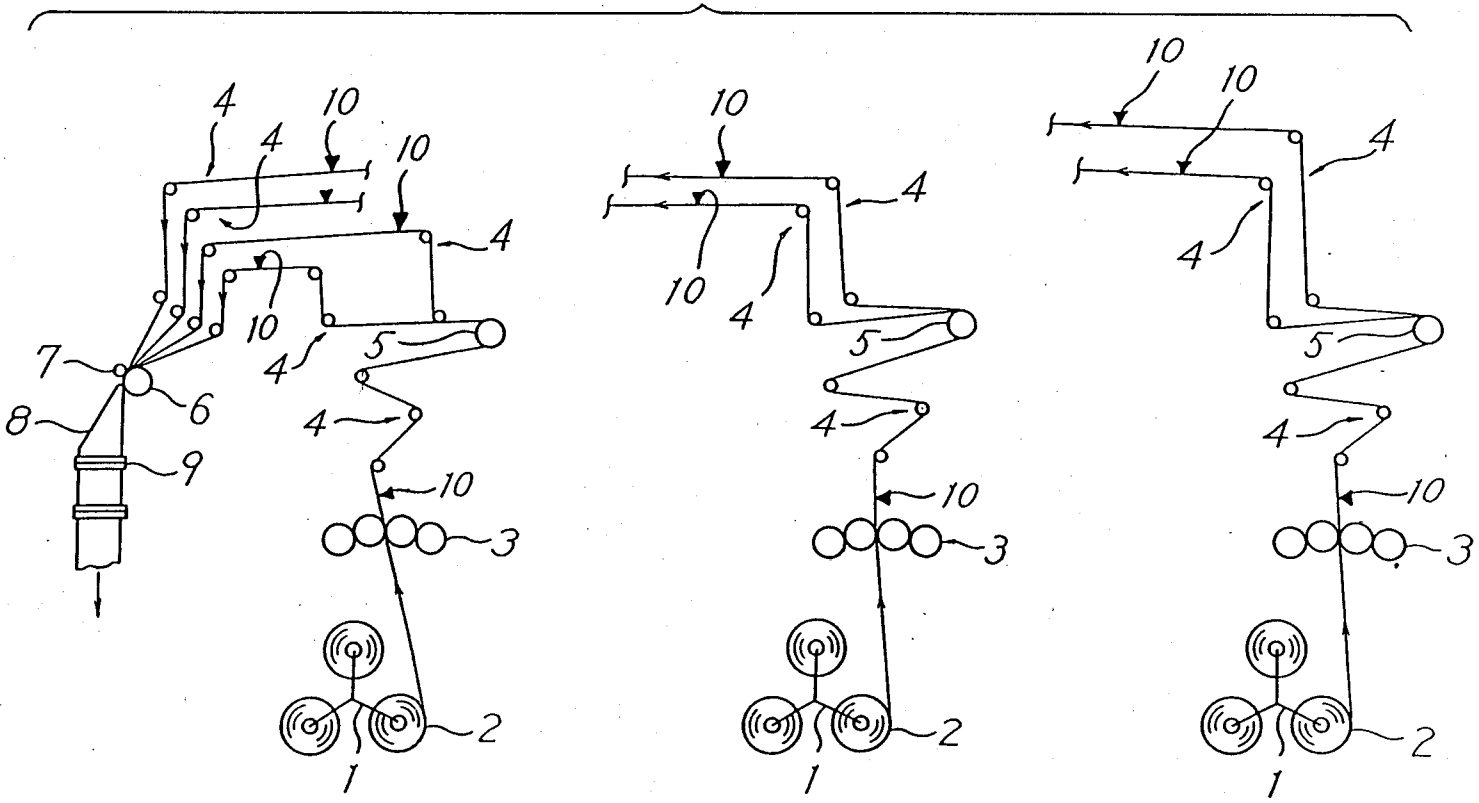
FIG. 2 is a side view of the conventional rotary press used for multi-web printing.

An apparatus which is employed in a rotary press for carrying out the method of preventing multiple breakage of webs according to the present invention is hereinunder described in detail by way of the embodiment shown in FIG. 1 The reference numeral 1 denotes reel stands, 2 a running web, 3 a printing unit, 4 a group of rollers, 5 intermediate drag rollers, 6 a triangular former drag roller, 7 a triangular former drag pressing roller, 8 a triangular former, 9 nipping rollers and 10 a web breakage sensor.

The triangular drag pressing roller 7 and each of the nipping rollers 9 are respectively provided with a nip pressure controller 11, to which a controller 12 sends a signal for decreasing the nip pressure which has been changed in accordance with the web breakage signal or signals received from one or more of the web breakage sensors 10.

As for the operation of the apparatus for carrying out the method of preventing multiple breakage of webs employed in the above rotary press, the web 2 mounted on the reel stands 1 is run to the printing unit 3 and is printed. The printed web is then guided by the group of rollers 4 to the intermediate drag rollers 5, and then slit into two strips each being half the width of the original web. After being slit, each of these webs is again guided by the group of guide rollers 4 to the triangular former drag roller 6 and, together with all the other webs which have come from other units, is pressed by the triangular former drag pressing roller 7 and is folded by the triangular former 8 before each web is conveyed out of the press through the nipping rollers 9.

In the above rotary press, the tension of each running web 2 upstream of the triangular former 8 is determined by the frictional force between the triangular former drag pressing roller 7 and the triangular former drag roller 6 and the webs 2 which are running therebetween, the total value of which is constant. The above mentioned frictional force is caused by the pressing force of the triangular former drag pressing roller 7. Therefore, when one of the running webs 2 is broken, since the total tension of each web is fixed, the tensions applied to each of the running webs 2 which are not yet broken become larger. Moreover, during the transient period of this phenomenon the enlarged tension of each web is further momentarily increased. As a result, each of the running webs which remains unbroken is subjected to an excessively large degree of tension and any of the webs may follow the already broken web and break. To prevent the breakage of another web which would be induced by the rupture of the first web, when this first running web 2 is broken, the corresponding web breakage sensor 10 senses the breakage and sends a signal to the controller 12. The controller 12, upon receipt of the above signal, quickly transmits to each of the nip pressure controllers 11 the signal for decreasing the pressing force of the former drag pressing roller 7 as well as that of each of the nipping rollers 9 on the basis of the number of webs 2 still running, thereby preventing the breakage of any of the remaining running webs 2 which would be caused by the first breakage.

Furthermore, the breakage of a first web 2 causes the tension applied to each of the remaining webs 2 to be momentarily increased. Because of the presence of viscoelastic characteristics in the running webs 2, however, it takes several seconds for another web to be broken, during which period the above described controlling system operates to prevent the rupture of any of these remaining running webs.

As described above, the rotary press employed for multi-web printing according to the present invention is provided with the web breakage sensors which sense the rupture of any of the running webs and transmit the detecting signal to the controller. Upon receipt of the signal from any one of the sensors, the controller sends to the nip pressure controllers the nip pressure signal which has been changed on the basis of the number of webs still running to decrease the nip pressure of the former drag pressing roller and each of the nipping rollers, thereby preventing the occurrence of breakage of any other web. With the above arrangement, it is possible that, when any one of the running webs is ruptured, the increase in the degree of tension applied to each of the webs still running can be quickly suppressed, and that the rupture of any other web which might be caused by the first breakage can be automatically and reliably prevented.

While there is shown and described a presently preferred embodiment of the invention, it is to be clearly understood that the invention is not limited thereto, but may be variously embodied and practiced within the scope of the following claim.

What is claimed is:

1. A method of preventing the breakage of moving webs in a press employing a plurality of webs when one or more of the moving webs break, the press having a drag roller over which said plurality of moving webs run, a pressing roller adjacent said drag roller and pressing against said plurality of webs in an adjustable web pressing engagement with said drag roller for exerting an adjustable pressure on said plurality of webs to tension each of said webs at a predetermined amount, said method comprising:

detecting the breakage of any of said plurality of webs;

generating a signal indicative of the number of webs detected as being broken; and controlling said pressing roller in response to the generation of the signal to reduce the pressure exerted on said webs in an amount corresponding to the detected number of broken webs as indicated by the generated signal for maintaining each of the remaining unbroken webs at said predetermined tension.

* * * * *